US007016513B2

(12) United States Patent
Noselli

(10) Patent No.: US 7,016,513 B2
(45) Date of Patent: Mar. 21, 2006

(54) VARIABLE DISPOSITION WIDE BAND MULTI-WAY LOUDSPEAKERS

(75) Inventor: Guido Noselli, Brescia (IT)

(73) Assignee: Outline S.n.c. di Noselli G.& C., Brescia (IT)

( * ) Notice: Subject to any disclaimer, the term of this patent is extended or adjusted under 35 U.S.C. 154(b) by 465 days.

(21) Appl. No.: 10/300,270

(22) Filed: Nov. 20, 2002

(65) Prior Publication Data

US 2003/0068058 A1 Apr. 10, 2003

Related U.S. Application Data

(63) Continuation-in-part of application No. 09/531,902, filed on Mar. 20, 2000, now abandoned.

(30) Foreign Application Priority Data

Mar. 2, 2000 (IT) ..... 98A0070

(51) Int. Cl.
*H04R 25/00* (2006.01)

(52) U.S. Cl. ..... 381/386; 381/303; 381/345; 181/150; 181/191

(58) Field of Classification Search ..... 381/300, 381/301, 303–305, 334, 335, 345, 386; 181/150, 181/199

See application file for complete search history.

(56) References Cited

U.S. PATENT DOCUMENTS 5,550,926 A * 8/1996 Tsao ..... 381/386
6,176,346 B1 * 1/2001 Wiener ..... 181/199

* cited by examiner

*Primary Examiner*—Suhan Ni
(74) *Attorney, Agent, or Firm*—McGlew and Tuttle, P.C.

(57) ABSTRACT

A sound system employing wide band loudspeakers, which includes one or more loudspeakers constructed to be placed and housed one inside the other in a closed configuration for transporting and storing and to be detached one from the other and positioned in different combinations in a combined functional configuration.

20 Claims, 6 Drawing Sheets

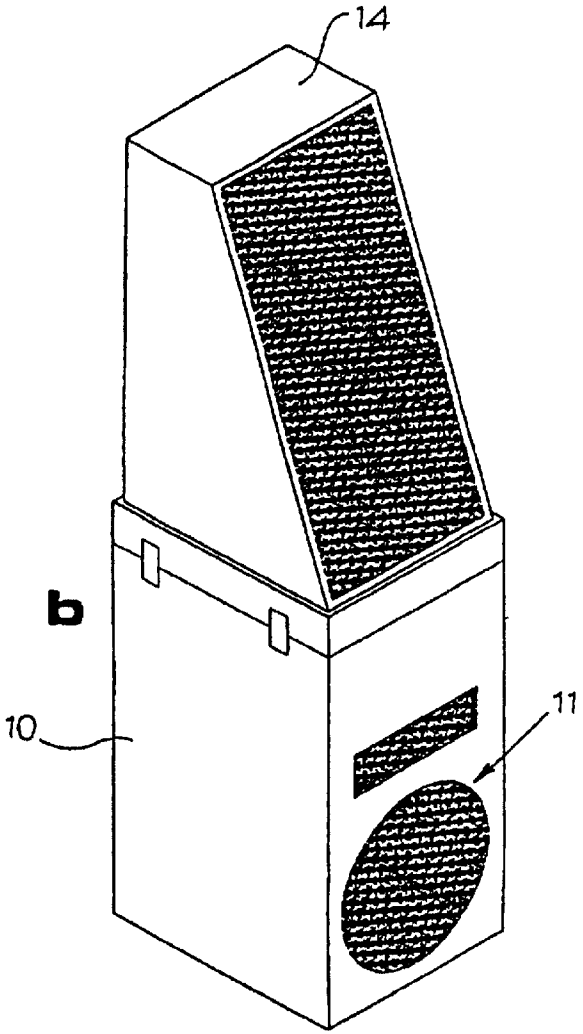
Fig. 3
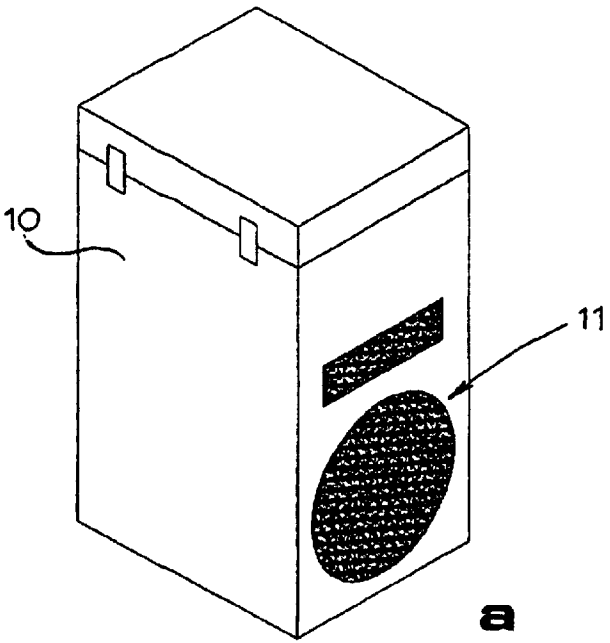

VARIABLE DISPOSITION WIDE BAND MULTI-WAY LOUDSPEAKERS

This is a Continuation-In-Part of application Ser. No. 09/531,902 filed Mar. 20, 2000, now abandoned and the entire disclosure of this prior application is considered to be part of the disclosure of the accompanying application and is hereby incorporated by reference therein.

FIELD OF THE INVENTION

The present invention relates to wide band multi-way loudspeakers.

BACKGROUND OF THE INVENTION

The professional amplification and sound recording sector is well aware that in order to reach acceptable quality in the reproduction of a musical event such as musical instruments and/or microphones, either using a pre-recorded program or amplifying live the sound source, the reproduction system of amplification or sound recording must reproduce a wide range of frequencies, from very low (30 Hz, for example) to the highest pitch (15000 Hz for example) in a balanced way and with sufficient distribution of energy.

Furthermore, this system must be able to reproduce this wide band at the required level, without harmful distortion for those listening to the musical event. In order to achieve high levels capable of covering wide areas with a large public, very high power together with adequate transducer efficiency is necessary, especially and above all at low frequencies.

Therefore, the speaker which has the task of reproducing the sound range having low frequencies must be equipped with a speaker or speakers suitable for supporting high pilot voltage besides having high transducer efficiency, achieved thanks to a large diameter diaphragm and/or a very high peak to peak excursion capacity of the same, or also thanks to a sound reproducer, like the horn, which acting as a true impedance transformer in relation to the means of propagation, the surrounding air, increases its efficiency because of its more favorable adaptation to sound.

In any case, however, a speaker like this, performing well at low frequencies, in particular if it has a horn sound reproducer, is large and takes up a lot of space. The larger the horn for low frequency is, the larger the phase inverter and band-pass "cabinet", made according to the principle of recovery of rear emission of the speaker, will be. In the same way the larger the classical and simple closed "cabinet" operating according to the principle of pneumatic suspension is, the lower the frequencies reproduced and the higher the sound energy produced in the surrounding space will be.

Therefore, in order to reproduce these frequencies it is usual to use separate and dedicated speakers called "subwoofers", because they are used to reproduce lower frequencies than the "woofer" which usually house one or more specialized speakers in "cabinets" varying in size from 100 to 300 $dm^3$ (litres) of overall volume to well over this figure, which are very large or anyway by no means easy to manage.

The latter characteristic, necessary to achieve high low frequency efficiency, if on the one hand hardly impairs the result in terms of loss of space in the fixed type of installation, it does on the other hand negatively impair the type designed to be portable where, because of economic reasons and running costs, the means of transport of the necessary materials is only just the right size or even slightly too small.

This often results in the use of "reduced band" transportable sound systems both for pre-recorded and live music, where the reproduction of the low frequency range, entrusted to the aforesaid "subwoofer", is almost completely lacking, with serious impairment of the musicality and the impact that this specific speaker makes on the musical event.

In other words, for those using portable amplification systems, such as small bands or small rent-out services who have limited available space because of the few and small means of transport they have at their disposition, bearing also in mind the growing costs of purchasing and running larger vehicles, the sound reproduced is very often penalized because of these people deciding not to use one or more special low frequency speakers in addition to the necessary wide band speakers, the so called satellites, which are usually much smaller.

SUMMARY AND OBJECTS OF THE INVENTION

This given, the aim of the present invention is to resolve such a problem by introducing a new concept in the construction of a sound system, or better the speakers or cabinets needed to achieve it, suitable for reproducing the whole range of the sound spectrum as far as the lowest frequencies.

The solution, at the basis of this invention, consists in being able to use wide band speakers which can, either vary in volume, or, when being transported or stored, use the empty space needed by the acoustic volume inside the "subwoofer", or in the largest speakers required for reproduction, to house the wide band speakers or satellites.

Each of the speakers generate first and second predetermined sound ranges with a respective band of frequencies and required sound pressures;

The acoustic volumes act as respective acoustic loads which are equivalent to an accurately calculated high-pass filter for obtaining reproduction of the respective band of frequencies and required sound pressures for the predetermined sound ranges.

The acoustic load of the cabinet of the subwoofer (the first cabinet) is equivalent to a high-pass filter tuned at a precise resonant frequency by means of ports or slots communicating with an exterior of the first cabinet in order to form a phase inversion loudspeaker or bass reflex speaker based on a Helmholtz resonator principle and thus to obtain, with substantially a smallest sizes, a lowest reproducible frequency at −3 dB, simultaneously increasing efficiency at a same power voltage.

The second cabinet of the satellite speaker with a second speaker driver is also a bass reflex loudspeaker, with a second acoustic volume functioning as an acoustic load and communicating with an exterior of the second cabinet by means of ports or slots whose dimensions have been chosen to tune the second acoustic volume at a frequency determined by the performance required at low frequencies.

This acoustic volume, in fact, as it is necessary and therefore cannot be reduced without impairing the reproduction capacity of the lower range of the sound spectrum, is thus fully utilized also with the objective, once again acoustic, of housing the total overall space occupied by the wideband loudspeaker system, with the advantage of reducing running costs, without penalizing the available quality of reproduction.

On the basis of another method of construction, the loudspeaker can be connected to and extracted from a container which, when open helps to increase, using its internal space, the acoustic volume because of an increase in the load of the low frequencies.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIGS. 3*a* and *b* show a system with a satellite speaker in the open position ready for use and closed ready to be repositioned;

DESCRIPTION OF THE PREFERRED EMBODIMENT

Figure 1:
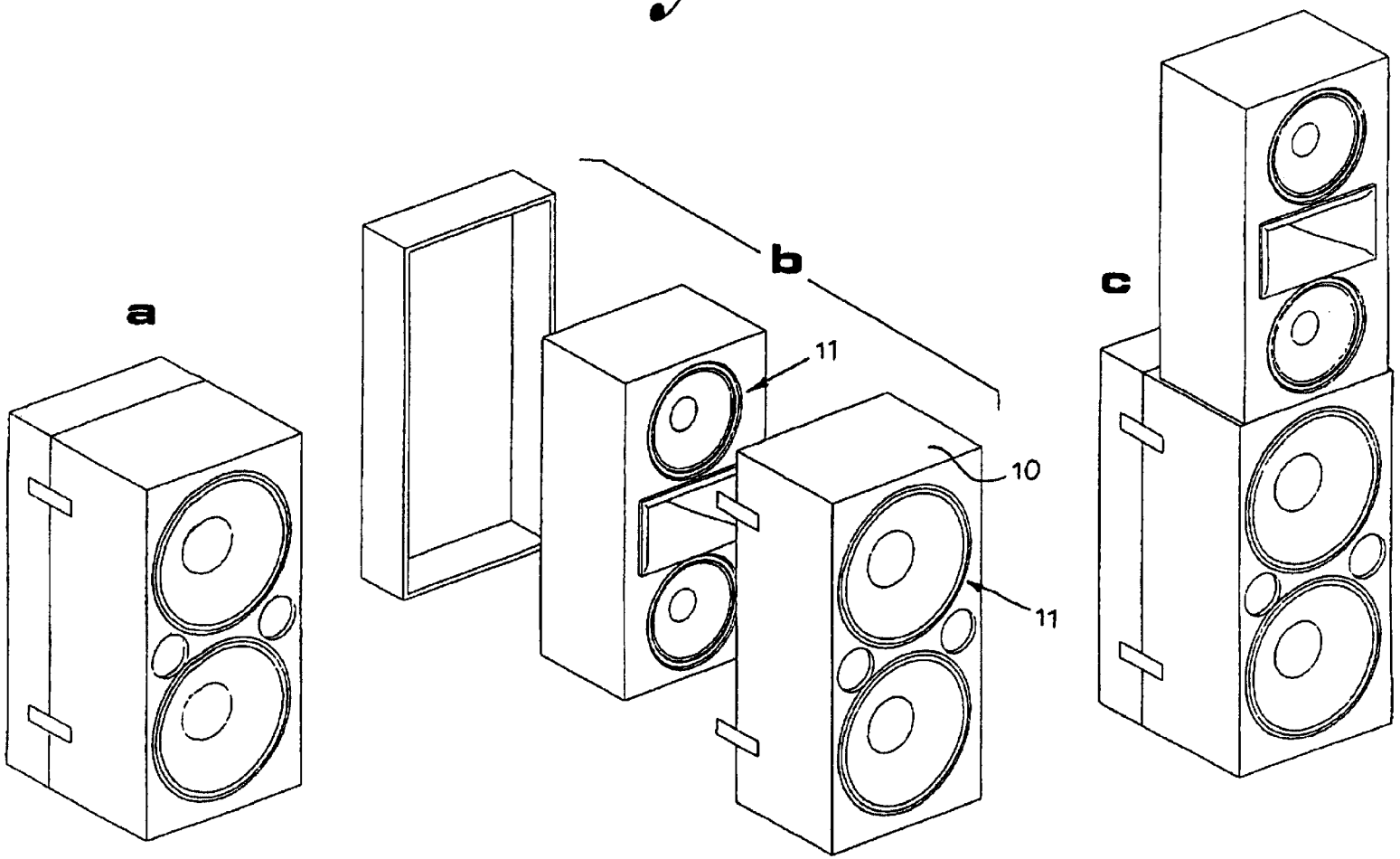
FIGS. 1*a, b*, and *c* show a reflex loudspeaker system closed, in the opening phase and open ready for use, in that order.

Referring to the drawings, the concept according to the present invention can be adapted and used, following appropriate construction changes to the cabinet 10, with any sound system made up of loudspeaker drivers 11, of whatever material and type, including those already housing a pilot amplifier for the loudspeakers it is equipped with, to form an almost infinite series of compositions and configurations, differing in size and shape, from the simplest to the more complex, in order to suit the needs.

The first cabinet 10 defines a first acoustic volume inside the cabinet 10. The first speaker driver 11 is connected to the first cabinet 10 and acoustically connected to the first acoustic volume on an upstream side of the first speaker driver 11. The first speaker driver 11 cooperates with the first acoustic volume to generate a first predetermined sound range with predetermined characteristics.

The second cabinet or satellite defines a second acoustic volume and is connectable to the first cabinet in a first collapsed combination and in a second operational combination.

A second or satellite speaker driver is connected to the second cabinet 14, and the second speaker driver is acoustically connected to the second acoustic volume on an upstream side of the second speaker driver. The second speaker driver cooperates with the second acoustic volume to generate a second predetermined sound range with predetermined characteristics. The second predetermined sound range is complementary to the first predetermined sound range. The second cabinet 14 is arranged inside the first acoustic volume in the first collapsed combination. The second cabinet 14 is arranged outside the first acoustic volume in the second operational combination.

Figure 2:
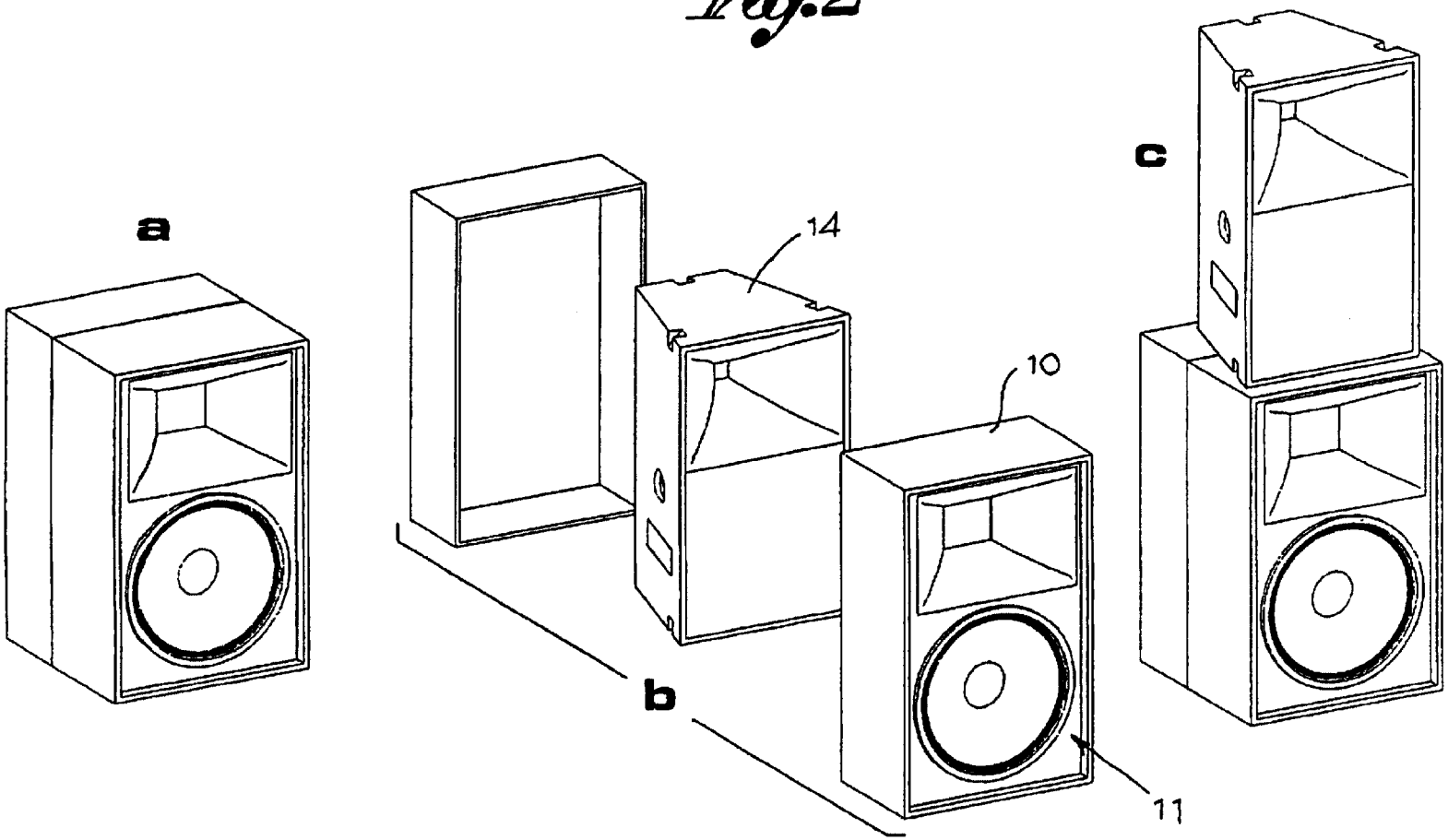
FIGS. 2*a, b* and *c* show the same views of another system with exponential shaped duct port.

The first cabinet 10 includes two first cabinet parts, the front and back as shown in FIGS. 1 and 2, movable between first and second positions for inserting and removing the second cabinet 14 into and out of the first acoustic volume of the first cabinet.

As shown in FIGS. 1 and 2, the first position of the two first cabinet parts is for the two cabinet parts to be together and define the first acoustic volume. The second position of the two cabinet parts opens the first acoustic volume to receive, or remove, the second cabinet.

Figure 5:
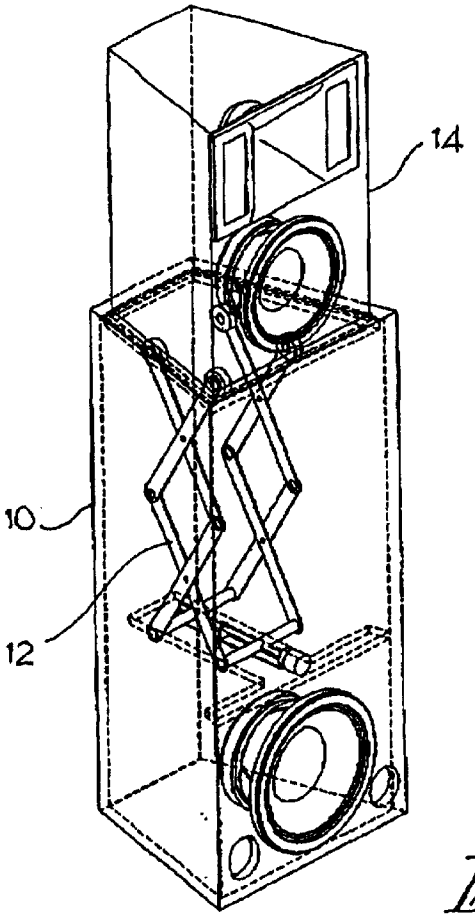
FIG. 5 shows a system with a variable volume satellite speaker which slides out using a mechanical means (either pneumatic or electro-mechanical)
Figure 4:
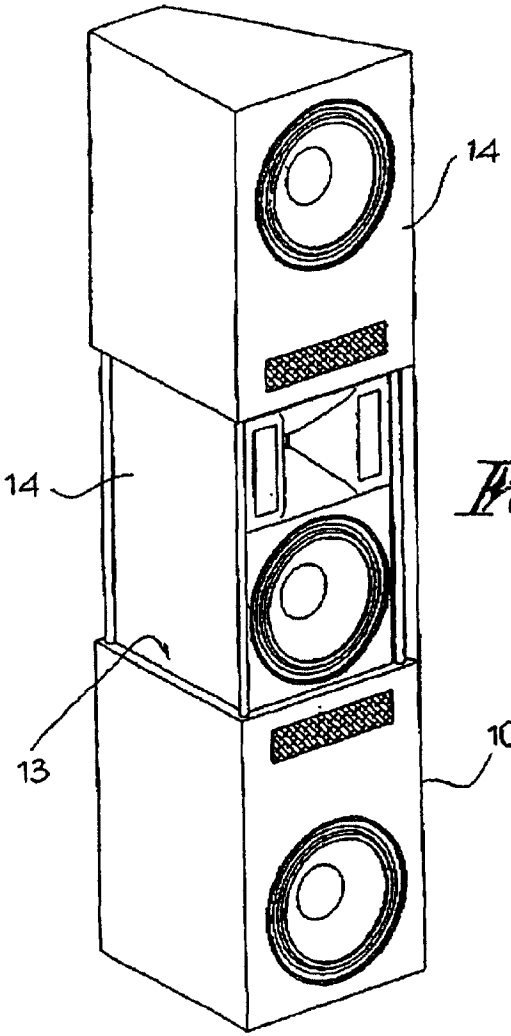
FIG. 4 shows a telescopically extractable loudspeaker system.

As shown in FIGS. 4 and 5, the first or expanded position of the two cabinet parts defines the first acoustic volume, and the second or collapsed position of the two cabinet parts collapses the first cabinet to receive the second cabinet.

The first or rear cabinet part in FIGS. 1 and 2 can be a removable hatch which, when closed after the second cabinet 14 has been removed, restores conditions of air-tightness and rigidity necessary for correct operation during use of the first cabinet 10 and the first speaker driver 11.

In addition mechanisms, 12, can be used to either automatically or semi-automatically or manually introduce and/or extract the satellite speakers 14 from the housing cabinet when they have to be used, as shown, for example in FIGS. 3–5.

In the system in FIG. 3, the satellite 14, once removed from the container cabinet 10 (subwoofer) is turned upside down and attached to it to form a loudspeaker system to reproduce sound giving high performance even in the low bass frequencies. When the system is closed the satellite 14 enters the subwoofer box 10 and at the same time it closes the container ready to be transported: in this way the satellite is protected (the subwoofer becoming a container and a means of transport).

FIG. 4 shows another embodiment of the present invention in which the "satellite" always remains physically connected to the subwoofer. The structure of the last varies between the position when in use and during transport, increasing or reducing the volume of the acoustic load equivalent to a high-pass filter by means of a telescopically symmetrical sliding mechanism (either manual, pneumatic or electro-mechanical) which at the same time frees the satellite for use.

FIG. 5 shows a variant of the same embodiment in which the "satellite", always remaining physically connected to the subwoofer, slides out from the top side of the subwoofer cabinet, increasing or reducing the volume of the acoustic load equivalent to a high-pass filter between the position when in use and during transport, by means of a mechanism (either manual, pneumatic or electro-mechanical).

Figure 6:
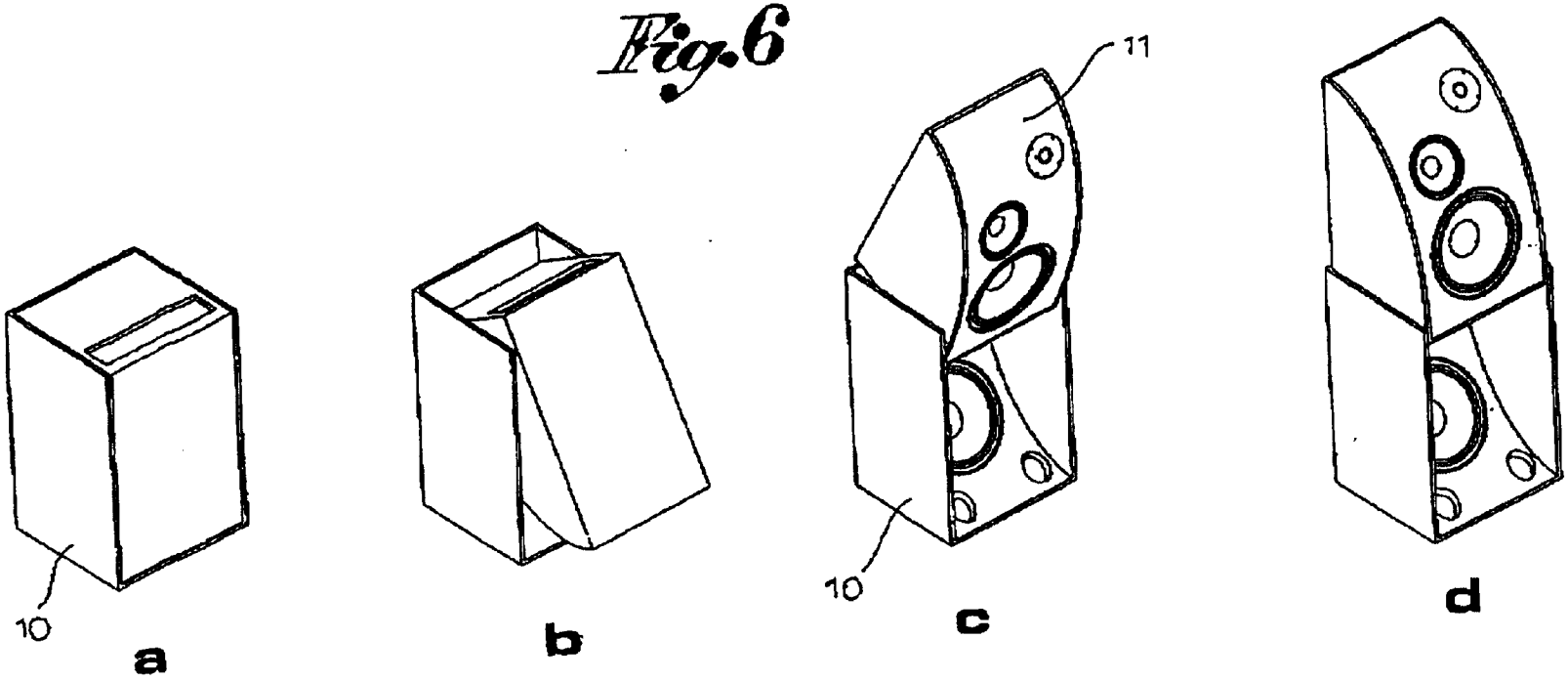
FIGS. 6*a, b, c* and *d* show various stages of a speaker hinged to a container which can house it.
Figure 7:
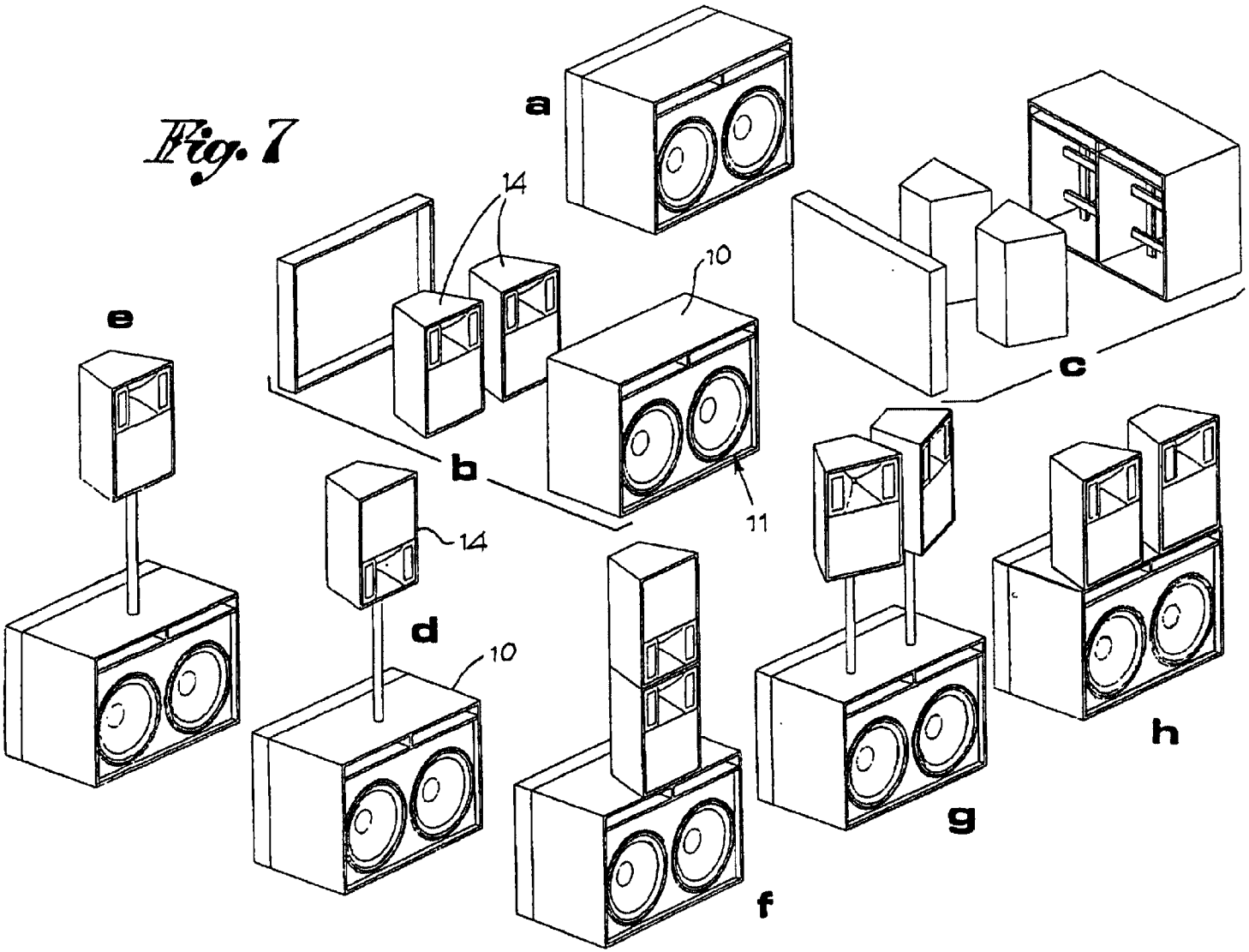
FIGS. 7*a, b, c, d, e, f* and *g* show another system of closed loudspeakers, in the opening phase and in various different combinations.

FIG. 6 shows another embodiment of the present invention derived directly by the preceding ones, in which the "satellite" is no longer housed in the volume which acts as a high-pass acoustic load during transport, but is up against the front panel of the subwoofer, which has a shaped surface, favoring the reinforcement of low frequencies reproduced by the loudspeaker driver mounted in it and loaded with an acoustic volume tuned in "bass reflex" configuration.

In this way, when the "satellite" is turned through 180° to be used, the space freed in the subwoofer enclosure, which it previously filled, behaves in the same way as a horn mouth, not only reinforcing the subwoofer's sound emission as explained above, but reinforcing the sound coming from the load volume of the "satellite" itself, by means of the tubing slot made for that purpose in its base. The subwoofer and satellite are therefore also in this case "bass reflex" type enclosures, the subwoofer partially "horn" loaded, as they are permanently physically connected and therefore used together, as with the embodiments of FIG. 4/5, complementing one another from both a structural and geometric point of view benefitting from reinforcement of the low frequencies due to such a configuration, and combining to form a complete system which can for example be 4-way, as shown in the drawings.

In creating the systems according to the invention, different materials for the loudspeaker housing can be used which are, to a greater or less degree, resistant to knocks and/or casters mounted in key positions so that it is possible to move it about easily so that it acts, not only as a means of transport but also as a means to protect the loudspeakers housed inside.

Worthy of mention is also the possibility of inserting material and objects into the "sound cabinet", either separately or together with the "satellite" speakers, which otherwise would occupy further precious space.

In conclusion, the idea of the described invention is fully achieved, without having to come to compromises, by creating a housing and protection system of a PA system, which is housed inside it during transport and which greatly facilitates this operation.

This system is achieved in such a way that, once free of its contents, it becomes in itself either a fully operational speaker in the frequency level it is required to reproduce or it becomes a sound load for the loudspeaker extracted from it.

While specific embodiments of the invention have been shown and described in detail to illustrate the application of the principles of the invention, it will be understood that the invention may be embodied otherwise without departing from such principles.

What is claimed is:

1. A sound system comprising:

a first cabinet defining a first acoustic volume;

a first speaker driver connected to said first cabinet, said first speaker driver being acoustically connected to said first acoustic volume on an upstream side of said first speaker driver, said first speaker driver cooperating with said first acoustic volume to generate a first predetermined sound range with predetermined characteristics;

a second cabinet defining a second acoustic volume and connectable to said first cabinet in a first and second combination;

a second speaker driver connected to said second cabinet, said second speaker driver being acoustically connected to said second acoustic volume on an upstream side of said second speaker driver, said second speaker driver cooperating with said second acoustic volume to generate a second predetermined sound range with predetermined characteristics, said second cabinet being arranged inside said first acoustic volume in said first combination, said second cabinet being arranged outside said first acoustic volume in said second combination.

2. A sound system in accordance with claim 1, wherein:

said first cabinet includes two first cabinet parts movable between first and second positions for inserting and removing said second cabinet into and out of said first acoustic volume.

3. A sound system in accordance with claim 2, wherein:

said first position of said two first cabinet parts defines said first acoustic volume;

said second position of said two first cabinet parts opens said first acoustic volume to receive said second cabinet.

4. A sound system in accordance with claim 2, wherein:

said first position of said two first cabinet parts defines said first acoustic volume;

said second position of said two first cabinet parts collapses said first cabinet to receive said second cabinet.

5. A sound system in accordance with claim 1, wherein:

each of said first and second predetermined sound ranges have a respective band of frequencies and required sound pressures;

said first and second acoustic volumes act as respective acoustic loads which are equivalent to an accurately calculated high-pass filter for obtaining reproduction of said respective band of frequencies and required sound pressures for respective said first and second predetermined sound ranges.

6. A sound system in accordance with claim 2, wherein:

said first cabinet part is a removable hatch which, when closed after said second cabinet has been removed, restores conditions of air-tightness and rigidity necessary for correct operation during use of said first cabinet and said first speaker driver.

7. A sound system in accordance with claim 5, wherein:

said acoustic load of said first cabinet is equivalent to a high-pass filter tuned at a precise resonant frequency by means of ports or slots communicating with an exterior of said first cabinet in order to form a phase inversion loudspeaker or bass reflex speaker based on a Helmholtz resonator principle and thus to obtain, with substantially a smallest sizes, a lowest reproducible frequency at −3 dB, simultaneously increasing efficiency at a same power voltage.

8. A sound system in accordance with claim 1, wherein:

said second cabinet with said second speaker driver is a bass reflex loudspeaker, said second acoustic volume functions as an acoustic load and communicates with an exterior of said second cabinet by means of ports or slots whose dimensions have been chosen to tune said second acoustic volume at a frequency determined by the performance required at low frequencies.

9. A sound system in accordance with claim 2, wherein:

said second cabinet is connected to said first cabinet when said two first cabinet parts are in both said first and second positions.

10. A sound system according to claim 1, wherein:

said second cabinet is a cabinet of a subwoofer;

a third speaker driver is connected to said second cabinet and generates a third predetermined sound range with predetermined characteristics, said third predetermined sound range being complementary to said first and second predetermined sound ranges.

11. A sound system in accordance with claim 1, wherein:

said first and second cabinets are connected either by mechanical, electro-mechanical or pneumatic means to insert said second cabinet into, and extract said second cabinet from, said first cabinet.

12. A sound system in accordance with claim 1, wherein:

said first cabinet completely surrounds said second cabinet in said first combination.

13. A sound system in accordance with claim 1, wherein:

said second predetermined sound range is complementary to said first predetermined sound range.

14. A sound system comprising:

a first cabinet defining a first acoustic volume and also defining a horn mouth;

a first speaker driver connected to said first cabinet, said first speaker driver being acoustically connected to said first acoustic volume on an upstream side of said first speaker driver, said first speaker driver being acoustically connected to said horn mouth on a downstream side of said first speaker driver, said first speaker driver cooperating with said first acoustic volume and said horn mouth to generate a first predetermined sound range with predetermined characteristics;

a second cabinet pivotally connected to said first cabinet between first and second cabinet positions, said second cabinet defining a second acoustic volume;

a second speaker driver connected to said second cabinet, said second speaker driver being acoustically connected to said second acoustic volume on an upstream side of said second speaker driver, said second speaker driver cooperating with said second acoustic volume to generate a second predetermined sound range with predetermined characteristics, said second cabinet being arranged inside said horn mouth of said first cabinet in said first cabinet position.

15. A sound system in accordance with claim 14, wherein:

said first and second cabinet positions are angularly spaced by substantially 180 degrees.

16. A sound system in accordance with claim 14, wherein:

said first and second acoustic volumes are tuned in a bass reflex configuration;

said second cabinet defines a tuning slot in communication with said horn mouth in said second cabinet position.

17. A sound system in accordance with claim 14, wherein:

said second predetermined sound range is complementary to said first predetermined sound range.

18. A method of disassembling a sound system, the method comprising the steps of:

providing a first cabinet defining a first acoustic volume and having a first speaker driver acoustically connected to said first acoustic volume on an upstream side of said first speaker driver, said first speaker driver cooperating with said first acoustic volume to generate a first predetermined sound range with predetermined characteristics;

providing a second cabinet defining a second acoustic volume and having a second speaker driver acoustically connected to said second acoustic volume on an upstream side of said second speaker driver, said second speaker driver cooperating with said second acoustic volume to generate a second predetermined sound range with predetermined characteristics connecting said first and second cabinets in an operating combination to generate sound in said first and second predetermined sound ranges;

moving said second cabinet inside said first acoustic volume to disassemble the sound system into a collapsed combination.

19. A method in accordance with claim 18, wherein:

said moving includes one of sliding or rotating said second cabinet in relation to said first cabinet.

20. A method in accordance with claim 18, wherein:

said second predetermined sound range is complementary to said first predetermined sound range.

* * * * *